US005432037A

United States Patent [19]

Nishikiori et al.

[11] Patent Number: 5,432,037

[45] Date of Patent: Jul. 11, 1995

[54] IMAGE-FORMING PROCESS, DEVELOPER AND IMAGE-FORMING SYSTEM

[75] Inventors: Takuya Nishikiori, Yokohama; Hiromi Horiuchi; Masayuki Hiroi, both of Tokyo, all of Japan

[73] Assignee: Mitsubishi Kasei Corporation, Tokyo, Japan

[21] Appl. No.: 977,563

[22] Filed: Nov. 17, 1992

[30] Foreign Application Priority Data

Nov. 28, 1991 [JP] Japan ..... 3-315016

[51] Int. Cl.[6] ..... G03G 13/16

[52] U.S. Cl. ..... 430/126

[58] Field of Search ..... 430/126, 106, 106.6, 430/109

[56] References Cited

U.S. PATENT DOCUMENTS

| | | | |
|---|---|---|---|
| 4,401,740 | 9/1985 | Kowabata et al. | 430/102 |
| 4,609,003 | 9/1986 | Knapp et al. | 430/108 |
| 4,946,755 | 8/1990 | Inoue | 430/110 |
| 4,965,162 | 10/1990 | Aonoma et al. | 430/110 |
| 5,180,650 | 1/1993 | Sacripante et al. | 430/106.6 |
| 5,188,918 | 2/1993 | Ziolo | 430/106 |

FOREIGN PATENT DOCUMENTS

| | | |
|---|---|---|
| 443800 | 8/1991 | European Pat. Off. . |
| 58-105236 | 6/1983 | Japan . |
| 63-149669 | 6/1988 | Japan . |

*Primary Examiner*—John Goodrow

*Attorney, Agent, or Firm*—Ladas & Parry

[57] ABSTRACT

Disclosed herein are an image-forming process which comprises steps of:

uniformly charging a latent image carrier by a charging member disposed in contact with or in close vicinity to the latent image carrier, forming a latent image pattern on the latent image carrier by exposure, developing the formed latent image pattern with a developer composed of image-developing particles and conductive particles having an average particle size of smaller than that of said image-developing particles, thereby transferring at least said image-developing particles in the developer to the latent image carrier, and transferring the image-developing particles transferred to the latent image carrier, to a transfer material; a developer for use in the image-forming process; and an image-forming system.

16 Claims, 1 Drawing Sheet

IMAGE-FORMING PROCESS, DEVELOPER AND IMAGE-FORMING SYSTEM

BACKGROUND OF THE INVENTION

The present invention relates to an electrophotographic image-forming process for using in a copying machine, laser printer or the like, a developer for using in the image-forming process, as well as an image-forming system.

Heretofore, a corona charger such as a corotron or scorotron has been used generally for charging a dielectric layer or the like of a latent image carrier (for example, a photoconductor) in an electrophotographic apparatus such as an electrophotographic copying machine or an electrophotographic printer. The corona charger requires a high voltage for charging the photoconductor and involves a drawback of generating a great amount-of ozone, thereby accelerating the deterioration of the photoconductor. In addition, an interest in the environmental protection is increasing in recent years and printers or the like other equipment are often used in a place near to a human body such as on a desk with proceeding in miniaturization and personal use of them. Therefore a charging device generating less amount of ozone which is toxic to a human body, has been demanded.

In view of the foregoing situation, a merit of contact charging such as Loller charging has been discovered and gradually put to practical use in recent years. The roller charging is a method of contacting the roller member obtained by coating a core such as a metal core with a conductive rubber or the like and forming into a roller-shape, with a photoconductor, and applying a voltage between the core of the roller and the photoconductor, thereby charging the surface of the photoconductor. The charging method has a merit capable of operating at a lower application voltage, enabling stable charging by superposing an alternating current voltage (refer to Japanese Patent Application Laid-Open (KOKAI) 63-149669(1988)) and generating less amount of ozone.

Further, in order to overcome the drawback in the contact charging method, that the surface of the photoconductor is liable to be damaged upon contact, a neighboring charging method for conducting charging making the surface of a charging member neighbor to a photoconductor may be considered.

However, when both of the two kinds of charging methods described above have been applied to a commercial copying laser printer to carry out a life test, it has been found that there occurs an additional problem to be solved.

That is, during repeating an image formation for a long time, toner particles or fine silica particles added as a fluidity improving agent are deposited, depending on the case, on the surface of a charging member to hinder uniform charging.

A blade cleaning method is used in a cleaning step of a transfer residual toner on a photoconductor of a copying machine/laser printer used for the experiment. The toner particles or fine silica particles are non completely scraped off by a cleaning blade and small amount of toner particles and fine silica particles remains on the surface of the photoconductor and then transfers from the surface of the photoconductor to the charging member. It is considered that the transferred toner particles and the fine silica particles are accumulated little by little to form an insulation layer on the surface of the charging member, during repeating the image formation, thereby failing to attain sufficient charge injection. In charging by the existent corotron or scorotron, such a problem can be coped with by merely cleaning the discharge wire periodically, since there has been a gap of greater than about 1 mm between the photoconductor and the transfer member, and the transfer of the toner particles and silica particles to the charging member is scarcely caused.

SUMMARY OF THE INVENTION

As a result of the present inventors' earnest study for providing a process capable of repeating use maintaining an advantage of the feature of low power source voltage and less ozone generation in the charging method described above, it has been found that by uniformly charging a latent image carrier by a charging member disposed in contact with or in close vicinity to the latent image carrier and developing by using a developer composed of image-developing particles and conductive particles having an average particle size of smaller than that of the image-developing particles, a stable uniform charging can be achieved stably in a repeating use over a long time and a sharp image can be formed stably. On the basis of the finding, the present invention has been attained.

In the first aspect of the present invention, there is provided an image-forming process which comprises steps of:

uniformly charging a latent image carrier by a charging member disposed in contact with or in close vicinity to the latent image carrier, forming a latent image pattern on the latent image carrier by exposure, developing the formed latent image pattern with a developer composed of image-developing particles and conductive particles having an average particle size of smaller than that of the image-developing particles, thereby transferring at least the image-developing particles in the developer to the latent image carrier, and transferring the image-developing particles transferred to the latent image carrier, to a transfer material.

In the second aspect of the present involution, there is provided a developer for using in an image-forming process comprising steps of uniformly charging a latent image carrier by a charging member disposed in contact with or in close vicinity to the latent image carrier, forming a latent image pattern on the latent image carrier by exposure, developing the formed latent image pattern with the developer, thereby transferring at least image-developing particles in the developer to the latent image carrier, and transferring the image-developing particles transferred to the patent image carrier, to a transfer material, the developer comprising the image-developing particles and conductive particles having an average particle size of smaller than that of the image-developing particles, and the amount of the conductive particles in the developer being 3 to 30 parts by weight based on 100 parts by weight of the image-developing particles.

In the third aspect of the present invention, there is provided an image-forming system comprising:

a latent image carrier, a charging member disposed in contact with or in close vicinity to the latent image carried member, for uniformly charging the latent image carrier, an exposure means for forming a latent image pattern on the latent image carrier, a means for developing the latent image pattern using a developer comprising image-developing particles and conductive particles having an average particle size of smaller than that of the image developing particles, transferring at least image-developing particles in the developer to the latent image carrier, and a means for transferring the image-developing particles transferred to the latent image carrier, to a transfer material.

DETAILED DESCRIPTION OF THE INVENTION

Figure 1:
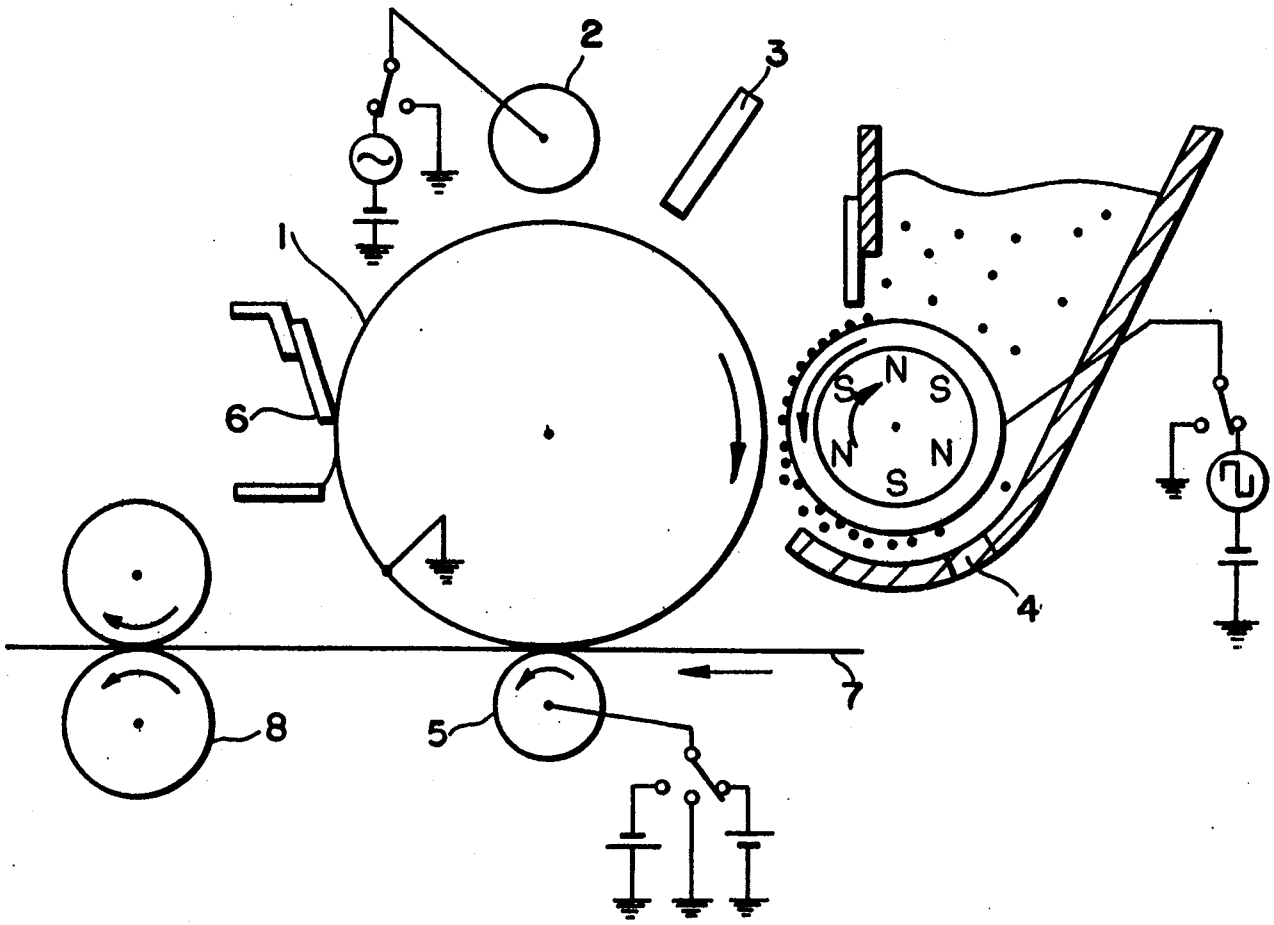
FIG. 1 illustrates a constitution of an image-forming apparatus for a reversal developing process according to the present invention.

The present invention will now be described more in details mainly with reference to an electrophotographic printer involving a charging step, an exposing step, a developing step, a transferring step and a cleaning step as an appropriate post-treatment.

As a material for the charging means (charging member) for charging the latent image carrier, any of conductive (electroconductive) materials such as metals, for example, iron, aluminum, stainless steel, brass, copper, as well as such metals coated with a conductive rubber is usable. Further, a conductive material coated at the surface thereof with a resin such as polyamide, cellulose, polyvinyl butyral or a conductive floro resin may also be used.

In the case of using the contact charging method, a charging member coated with a conductive rubber is preferably used for preventing the latent image carrier from damage upon contact.

In the case of using the neighboring charging method, the gap between the surface of the latent image carrier and the surface of the charging member disposed in close vicinity to the latent image carrier is preferably less than 100 $\mu$m, more preferably not more than 80 $\mu$m. If the gap is too large, it becomes difficult to attain uniform charging even when a voltage which is an AC voltage superposed on a DC voltage is applied.

For the shape of the charging member, there may be mentioned a blade, wire or plate. In the case where the charging member is formed as a roller-shape and is rotated in accordance with the rotation of the latent image carrier by using an interlocking mechanism or rotated by applying an independent external force, the surface to be used for the charging is always exchanged, thereby extending the working life of the charging member.

As the material for the latent image carrier, there can be used an inorganic photoconductor such as a-Se, $As_2Se_3$, CdS, ZnO, a-Si or the like, an organic photoconductor (OPC) and a photoconductive material laminated with an insulating material.

A voltage applied between the charging member and the latent image carrier may be a DC voltage or a DC voltage on which an AC voltage is superposed.

In the case of the DC voltage, $\pm$700 V no $\pm$3 kV is usually preferred. The potential charged to the latent image carrier depends on the gap between the latent image carrier and the charging member, and is determined by the Paschen's law.

Preferably, a DC voltage on which an AC voltage is superposed is used to obtain a more uniform charging. The amplitude of the alternating voltage is preferably greater than the voltage for starting discharge determined by the Paschen's law. The frequency is usually selected from a range of from about 50 Hz to about 3 kHz.

After charging the latent image carrier, a latent image pattern is formed on the latent image carrier by an exposure means.

As the developing means used in the present invention, known electrophotographic developing devices, for example, a two-component developing device, a magnetic one-component developing device or a non-magnetic one-component developing device can be used.

The two-component developing device is adapted to use a developer containing at least image-developing particles and carrier particles, to conduct frictional charging between the image-developing particles and the carrier particles and to transfer the charged image-developing particles to the latent image carrier, thereby visualizing the latent image pattern.

The magnetic one-component developing device is adapted to hold a developer containing at least magnetic image-developing particles by a magnetic field, to contact with or come close to the latent image carrier, and to transfer by charges obtained by friction between the image-developing particles and a developing device material, friction between the image-developing particles to each other or friction between the image-developing particles and auxiliary particles added for promoting the frictional charging, or to transfer with polarization force of the image-developing particles or charge injection by the electric field between the developing device material and the latent image carrier.

The non-magnetic one-component developing device is adapted to use a developer containing at least non-magnetic image developing particles, to hold the developer by the electrostatic deposition force to the developing device material, to contact with or to come close to the latent image carrier, to transfer to the latent image pattern by the same force as that in the magnetic one-component device and then to visualize the image.

The transfer material used in the present invention is, for example, paper or OHP sheet in a case of a usual copying machine or printer and it is a display substrate when it is applied to a display device such as an electronic copy board.

As the transferring method to the transfer material, there can be mentioned, for example, a method of transfer by applying an electrostatic force from the back of the transfer material by means of a corotron or a transfer roller, a method of indirect transfer through an adhesive roll or a transfer sheet, or a method of fusing to a transfer material by applying pressure or heat from the back of the transfer material.

The suitable post-treatment to be carried out subsequently in the present invention is, for example, a cleaning step for the transfer residue of image developing particles and a charge erasing step for the latent image pattern. However, the charge erasing step may be omitted if the uniform charging performance of the charging member is sufficient. In addition, the cleaning step may also be omitted in the case where the transfer efficiency in the transfer step is sufficiently high and the transfer residue of image developing particles, if present slightly, give no undesired effect on the repeated steps of charging, exposing and developing. The suitable post treatment referred to in the present invention also includes applying no treatment at all from the transfer step to the charging step in the next cycle. Further, more specifically, if the transfer efficiency is high and the cleaning step is omitted, a slight amount of image developing particles or external additives such as fine silica particles inevitably intrude into the charging step. In this case, the present invention can prevent the deterioration of the charging performance due to their accumulation and provide an outstanding effect.

The developer used in the present invention is composed of at least image developing particles and conductive particles having an average particle size of smaller than that of the image-developing particles.

The average particle size of the image-developing particles is usually from 3 to 30 μm, preferably from 5 to 20 μm.

Usually, as the image-developing particles, a toner composed of a binder resin, a colorant and, if necessary, a charge controlling agent is used in a case of applying a heat-fixing treatment to an image transferred to a transfer material such as paper. Further, in a case of employing the magnetic one-component developing system as the developing means, a magnetic toner composed of a binder resin, a magnetic powder, a colorant and, if necessary, a charge controller is used. If the magnetic powder or the resin is colored and imparts a satisfactory color to the toner, no colorant may be added.

The binder resin for the toner can be selected from a wide range including known material. For example, styrene resins (homopolymer or copolymer containing styrene or styrene substitute) such as polystyrene, chloropolystyrene, poly-α-methyl styrene, styrene chlorostyrene copolymer, styrene-propylene copolymer, styrene-butadiene copolymer, styrene-vinyl chloride copolymer, styrene-vinyl acetate copolymer, styrene-maleic acid copolymer, styrene-acrylate copolymer (styrene-methyl acrylate copolymer, styrene-ethyl acrylate copolymer, styrene-butyl acrylate copolymer, styrene-octyl acrylate copolymer and styrene-phenyl acrylate copolymer), styrene-methacrylate copolymer (styrene-methyl methacrylate copolymer, styrene ethyl methacrylate copolymer, styrene-butyl methacryate copolymer and styrene-phenyl methacrylate copolymer), styrene-methyl α-chloroacrylate copolymer and styrene acrylonitrile-acrylate copolymer; vinyl chloride resins; rosin modified maleic acid resins; phenol resins; epoxy resins; saturated or unsaturated polyesters; low molecular weight polyethylenes; low molecular weight polypropylenes; ionomer resins; polyurethanes; silicone resins; ketone resins; ethylene-ethyl acrylate copolymer; xylene resins and polyvinyl butyral may be exemplified. As the resin most preferred to the use in the present invention, there can be mentioned, for example, styrene resins, saturated or unsaturated polyesters and epoxy resins. The above-mentioned resins are not necessarily be used alone but two or more of them may be used in combination.

The blending ratio by weight of the binder resin to the magnetic powder in the magnetic toner can be selected from a range of from 1:3 to 7:1 while considering the developability and fixing property to the transfer material. They are kneaded and dispersed together with, if necessary, a colorant or a charge controller in a kneader or the like, cooled, pulverized and classified to obtain a powder usually with an average particle size usually of 5 to 20 μm. Various kinds of known materials can be used as the toner ingredients described above.

The magnetic powder used in the present invention is a ferromagnetic substance showing ferromagnetism or ferromagnetism at a working circumstantial temperature (about 0° C. to about 60° C.) of PPC or the like. There can be mentioned those exhibiting ferromagnetism or ferrimagnetism in a temperature range from about 0° C. to about 60° C., among spinel ferrite such as magnetite ($Fe_3O_4$), maghemite ($\gamma$-$Fe_2O_3$) and an intermediate of magnetite and maghemite, ferrite ($M_xFe_{3-x}O_4$, wherein M represents Mn, Fe, Co, Ni, Cu, Mg, Zn, Cd or a mixed crystal system thereof), hexagonal ferrite such as $BaO.6Fe_2O_3$ and $SrO.6Fe_2O_3$, garnet-type oxide such as $Y_3Fe_5O_{12}$ or $Sm_3Fe_5O_{12}$, futile-type oxide such as $CrO_2$, metal such as Fe, Mn, Ni, Co and Cr, as well as other ferromagnetic alloys. Among them, fine particles (powder) of magnetite, maghemite or an intermediate of magnetite and maghemite which have an average particle size of not more than 3 μm, more preferably about from 0.05 to 1 μm such as those are preferred in view of both the performance and the cost. Each of the magnetic powders is used not only alone but two or more of them may be used combination.

As the colorant used for the toner, any of known dyes and pigments such as carbon black, lamp black, iron black, ultramarine, nigrosine dye, aniline blue, phthalocyanine blue, phthalocyanine green, hansa yellow G, rhodamine dyes or pigments, chrome yellow, quinacridone, benzizine yellow, rose bengale, triallymethane dyes, monoazo or disazo dyes or pigments can be used alone or as a mixture.

The amount of the colorant in the toner is preferably from 0.1 to 30 parts by weight and more preferably 0.5 to 10 parts by weight based on 100 parts by weight of the binder resin. If the amount of the colorant is too low, it tends to give poor coloring effect. On the other hand, if it is too large, the fixing property tends to be deteriorated.

Charge control for the toner may be conducted with the binder resin or dye and pigment per se. Alternatively, a charge controlling agent causing no trouble for the color reproduction may be used in combination, if necessary. As the positive charging controlling agent, a basic electron-donating substance such as nigrosine dye or a quaternary ammonium salt may be used, while an acidic electron-attracting substance such as a metal chelate or a metallized dye may be used as the negative charge controlling agent, by proper selection.

The amount of the charge controlling agent in the toner may be determined while considering conditions such as charging property of the binder resin, the amount of the colorant and manufacturing method including the dispersion method, as well as charging property of other additives. It is preferably from 0.1 to 10 parts by weight based on 100 parts by weight of the binder resin.

In addition, inorganic particles such as of metal oxides or inorganic materials subjected to a surface treatment by the organic substance described above may also be used.

The charge controlling agent may be used by admixing with the binder resin or depositing to the surface of the toner particles.

In addition, various kinds of additives such as plasticizer and releasing agent may be added in the toner for controlling thermal and physical properties. The amount is preferably from 0.1 to 10 parts by weight based on 100 parts by weight of the binder resin.

As the conductive particles having an average particle size of smaller than that of the image-developing particles used in the present invention, those particles having an average particle size of less than about $\frac{2}{3}$ of the average particle size of the image-developing particles and not more than 0.3 μm are preferred. The conductive particles used preferably have an electric resistivity of not more than $10^{11}$ ohm.cm, more preferably not more than $10^9$ ohm.cm and, most preferably from $10^3$ to $10^9$ ohm.cm. The electric resistivity is such a value as not providing a trouble to the charging performance for the latent image carrier even when the conductive particles are deposited to the surface of the charging member.

The resistivity was measured by charging conductive particles into a cylindrical vessel having a bottom of an electrode with an inner diameter of 20 mm and a side circumferential surface made of an insulation material, inserting from above an electrode of 20 mm in diameter and applying a voltage at 100 V in a state under a load of about 2 kg. The sample upon measurement was charged such that the interelectrode distance was about 5 mm.

As the material for the conductive particles, there can be mentioned, for example, metal such as Fe, alloy, oxide such as spinel ferrite, for example, magnetite or an intermediate product between magnetite and maghemite or ferrite ($M_xFe_3O_4$, wherein M reprcsents Mn, Fe, Co, Ni, Cu, Mg, Zn or Cd, or a mixed crystal system thereof), or $CrO_2$ or $TiO_2$. Further, for obtaining an optimum image quality, a treatment for increasing or decreasing the conductivity or a treatment of improving the triboelectric charging property such as a hydrophobicity-imparting treatment may be applied to the surface of the conductive particles.

There is no particular limitation in an the amount of the conductive particles but it is preferably from 1 to 50 parts by weight, more preferably 3 to 30 parts by weight based on 100 parts by weight of the image-developing particles.

Further, fluidity-improving particles used usually as the developer additives, for example, a fine powder of titania, alumina, silica or the like having a BET specific surface area of not less than 10 $m^2/g$, preferably not less than 50 $m^2/g$ or those applied with a hydrophobicity-imparting treatment to the surface of such fine powder may also be added.

The amount of the fluidity-improving particles may vary depending on the developing method, but it is generally from 0.01 to 5 parts by weight based on 100 parts by of the image-developing particles.

The image-forming process according to the present invention exhibits the-following particular phenomenon not found so far by adopting, in combination, a charging method of charging by a charging member disposed in contact with or in close vicinity to a latent image carrier and a developing method by using a developer containing conductive particles having an average particle size of smaller than that of the image-developing particles.

By repeating the image formation in accordance with the present invention, it results in a phenomenon that the conductive particles in the developer gradually deposits to the surface of the charging member. It is supposed that the particular effect according to the present invention can be attained by this phenomenon.

While various proposals have been proposed for incorporating conductive materials in a developer (Japanese Patent Application Laid-Open (KOKAI) No. 58-105236 (1983)), the incorporation of the conductive material is carried out with the purpose of cleaning off the surface of the photoconductor or leaking electric charges in the developer and it has not been considered therein for its gradually depositing to the charging member as in the present invention. Rather, the-deposition of the substance to the charging member has been avoided in the concept of the prior art since this might bring about undesired effect.

Accordingly, the image-forming process as in the present invention of combining a particular charging step and a particular developer, thereby depositing the conductive particles to the charging member, has not been considered in the prior art.

in an electrophotographic apparatus or a printer utilizing the imaging forming process according to the present invention, uniform charging can be attained stably and sharp image is formed stably while maintaining an advantageous characteristics of low power source voltage and less ozone generation, in repeating image formation for a long period of time.

EXAMPLES

The present invention will now be described in further detail and it should be noted that the present invention is not limited by the following examples unless it goes beyond the scope of the invention.

Example 1

FIG. 1 illustrates a constitution of an image-forming apparatus by a reversal developing system used in this example.

A neighboring charger 2, an exposure means 3, a developing device 4, a transfer roller 5 and a cleaning means 6 were disposed in this order to the circumferential surface of a latent image carrier 1 composed of a cylindrical aluminum pipe of a diameter of 30 mmϕ having an organic photoconductive material (specific dielectric constant:3) of 20 μm in thickness on the surface thereof, and image formation was conducted by successively passing through each of the processes by rotating the latent image carrier 1 at a circumferential speed of 40 mm/sec.

In the neighboring charger 2, a cylindrical molding product of 12 mmϕ in diameter made of a conductive rubber composed of EPDM and carbon black dispersing therein (rubber hardness: 80 degree, according to JIS-K 6301 A) was used and the neighboring charger 2 was disposed in parallel with the image carrier at a distance of about 50 μm from the image carrier. A DC voltage (−650 V) on which an AC voltage (850 V of amplitude and 1 kHz of frequency) was superposed was applied to the neighboring charger and charges were transferred to the image carrier to charge the surface to a potential of about −650 V.

A latent image pattern by an electrostatic charge distribution was formed on the latent image carrier by the exposure means 3.

As the image-developing particles, 100 parts by weight of a styrene-butyl acrylate-methyl methacrylate copolymer, 3 parts by weight of a low molecular weight polypropylene, 2 parts by weight of a chromium metallized dye and 105 parts by weight of a magnetite were blended, kneaded, pulverized and classified to prepare a magnetic toner of a volume average particle size of about 10 μm, usually charged negatively, and 100 parts by weight of the magnetic toner, 3 parts by weight of a magnetite powder as the conductive particles having an average particle size of 0.5 μm and an electric resistivity of $3\times10^6$ ohm.cm and 0.3 parts by weight of a silica powder having 75 $m^2/g$ of specific surface area and subjected to a silicone hydrophobicity-imparting treatment, were mixed in a Henschel mixer to prepare a negatively charging developer, and the developing device 4 was filled with the resultant developer.

In the developing device 4, a cylindrical conductive non-magnetic sleeve was disposed in parallel with and in close vicinity to the latent image carrier 1, the sleeve and a magnet coaxially incorporated in the sleeve were rotated respectively, a magnetic brush of the filled developer was formed on the surface of the sleeve, and the magnetic brush was contacted with the latent image carrier 1, thereby transferring the toner to the image carrier 1. Upon development, a developing bias of a DC voltage (−500 V) on which a square wave at 2 kV of peak-to-peak level and 1 kHz of frequency was superposed, was applied to the sleeve.

The transfer roller 5 composed of a cylindrical molding product of 12 mmϕ in diameter, made of a conductive rubber having EPDM with carbon black dispersed therein (rubber hardness: 40 degree, according to JIS-K 6301A), was pressured against the latent image carrier 1 and rotated at an equal circumferential speed therewith. The voltage was so applied that +400 V was applied upon transfer, while +400 V and −800 V were switched upon non-transfer.

The cleaning means 6 was a cleaning blade system of abutting a urethane blade on the latent image carrier and physically scraping off the residual toner after the transfer.

After passing through the cleaning means, the image carrier returned again to the charging process by the neighboring charger and processed continuously and simultaneously for each of the processes.

When a continuous printing test was carried out for 10,000 sheets of A4-sized paper by using the above-mentioned apparatus, satisfactory image formation was attained from the initial sheet to 10,000th sheet.

Comparative Example 1

A printing test was carried out under the same conditions as those in Example 1, except for not using the magnetite powder of 0.5 μm in size in Example 1. Disturbance was observed in the image after printing about 200 sheets. A white silica powder thinly deposited to the surface of the neighboring charger.

Example 2

A printing test was carried out for 7,500 sheets under the same conditions as those in Example 1, except for using the neighboring charger in Example 1 as a contact-type charger by disposing it into contact with the latent image carrier and for using a developer obtained by mixing 100 parts by weight of the magnetic toner prepared in Example 1 and 20 parts by weight of MnZn ferrite having an average particle size of 3 μm and an electric resistivity of $2\times10^8$ ohm.cm as the conductive particles and 0.5 parts by weight of hydrophobic silica (trade name: R 972, manufactured by Degussa Co.) in a Henschel mixer. Clear images were obtained from the initial sheet to 7,500th sheet. Further, a brown substance deposited over the entire surface of the contact charger and an analysis of the deposits based on the X-ray diffractometry confirmed that the substance was a mixture of MnZn ferrite added to the developer and a slight amount of a magnetic toner.

Comparative Example 2

A printing test was carried out under the same conditions as those in Example 2 except for not using the MnZn ferrite of 3 μm in size in Example 2. Disturbance was observed in the image after printing about 1,000 sheets. White silica deposited to the charger like that in Comparative Example 1.

Example 3

A printing test was carried out for 10,000 sheets under the same conditions as those in Example 1, except for using instead of the developer used in Example 1, a developer obtained by mixing 100 parts by weight of the magnetic toner prepared in Example 1, 10 parts by weight of a MnZn ferrite powder with an average particle size of 1.5 μm and an electric resistivity of $1\times10^8$ ohm.cm and 0.5 parts by weight of a silicone-treated silica used in Example 1 in a Henschel mixer. Clear images were obtained from the initial sheet to 10,000th sheet. A brown substance deposited over the entire surface of the charger. X-ray diffractometry and carbon amount analysis confirmed that the deposits were composed of about 80 wt % of MnZn ferrite added to the developer and about 20 wt % of the magnetic toner.

What is claimed is:

1. An image-forming process which comprises steps of:

uniformly charging a latent image carrier with a surface of a charging member disposed in contact with or in close viciniy to the latent image carrier, forming a latent image pattern on the latent image carrier by exposure, developing the formed latent image pattern with a developer composed of image-developing particles and conductive particles having an average particle size of smaller than that of said image-developing particles, thereby transferring at least said image-developing particles in the developer to the latent image carrier, and transferring the image-developing particles transferred to the latent image carrier to a transfer material.

2. An image-forming process according to claim 1, wherein the conductive particles in the developer gradually deposit on the surface of the charging member by repeating at least one of the developing and transferring.

3. An image-forming process according to claim 1, wherein the charging member is composed of a roller-shaped charging member and the charging is carried out by said roller-shaped charging member disposed in close vicinity to the latent image carrier at a gap smaller than 100 μm.

4. An image-forming process according to claim 1, wherein a DC voltage on which an AC voltage is superposed is applied between the charging member and the latent image carrier in the charging step.

5. An image-forming process according to claim 1, wherein the conductive particles have an electric resistivity of not more than $10^9$ ohm.cm.

6. An image-forming process according to claim 1, wherein the amount of the conductive particles in the developer is frown 3 to 30 parts by weight based on 100 parts by weight of the image-developing particles.

7. An image-forming process according to claim 1, wherein the image-developing particles are a magnetic toner.

8. An image-forming process according to claim 1, wherein the developer contains fluidity-improving particles having a SET specific surface area of not less than 10 $m^2/g$.

9. In an image-forming process comprising steps of uniformly charging a latent image carrier by a charging member disposed in contact with or in close vicinity to the latent image carrier, forming a latent image pattern on the latent image carrier by exposure, developing the formed latent image pattern with a developer, thereby transferring at least image-developing particles in the developer to the latent image carrier, and transferring the image-developing particles transferred to the latent image carrier to a transfer material, the improved developer further comprising:

conductive particles having an average particle size of smaller than that of the image-developing particles, the amount of the conductive particles in the developer being from 3 to 30 parts by weight based on 100 parts by weight of said image-developing particles.

10. A developer according to claim 9, wherein an average particle size of the conductive particles is not more than $\frac{2}{3}$ of the average particle size of the image-developing particles and is not less than 0.3 $\mu$m.

11. A developer according to claim 9, wherein the conductive particles have an electric resistivity of not more than $10^9$ ohm.cm.

12. A developer according to claim 9, wherein the image-developing particles are a magnetic toner.

13. A developer according to claim 9, wherein the developer contains fluidity-improving particles having a BET specific surface area of not less than 10 $m^2/g$.

14. A developer according to claim 9, wherein the developer further contains fine silica particles or fine particles subjected to a hydrophobic treatment.

15. A developer according to claim 9, wherein the conductive particles is composed of at least one selected from the group consisting of magnetite, an intermediate product of magnetite and maghemite, and ferrite ($M_xFe_{3-x}O_4$, wherein M represents Mn, Fe, Co, Ni, Cu, Mg, Zn, Cd or a mixed crystal system thereof).

16. An image-forming system comprising:

a latent image carrier, a charging member disposed in contact with or in close vicinity to the latent image carried member, for uniformly charging the latent image carrier, an exposure means for forming a latent image pattern on the latent image carrier, a means for developing the latent image pattern using a developer comprising image-developing particles and conductive particles having an average particle size of smaller than that of the image developing particles, thereby transferring at least image-developing particles in the developer to the latent image carier, and a means for transferring the image-developing particles transferred to the latent image carrier, to a transfer material.

* * * * *